US008627524B2

(12) United States Patent
Urbanet et al.

(10) Patent No.: US 8,627,524 B2
(45) Date of Patent: Jan. 14, 2014

(54) HOUSEHOLD-TYPE WATER-RECIRCULATING CLOTHES WASHING MACHINE WITH AUTOMATIC CONTROL OF THE WASHLOAD WEIGHT, AND OPERATING METHOD THEREOF

(75) Inventors: Carlo Urbanet, Pordenone (IT); Silvano Cimetta, Treviso (IT); Mirko Gasparini, Pordenone (IT); Marco Giovagnoni, Udine (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 1470 days.

(21) Appl. No.: 11/252,587

(22) Filed: Oct. 19, 2005

(65) Prior Publication Data

US 2006/0107468 A1 May 25, 2006

(30) Foreign Application Priority Data

Nov. 23, 2004 (EP) ..... 04106014

(51) Int. Cl.
*D06F 35/00* (2006.01)

(52) U.S. Cl.
USPC ..... 8/158; 8/159

(58) Field of Classification Search
USPC ..... 8/158
See application file for complete search history.

(56) References Cited

U.S. PATENT DOCUMENTS

| | | | | |
|---|---|---|---|---|
| 5,161,393 | A * | 11/1992 | Payne et al. | 68/12.04 |
| 2002/0133886 | A1 * | 9/2002 | Severns et al. | 8/142 |
| 2003/0041390 | A1 * | 3/2003 | Kim et al. | 8/158 |
| 2003/0097719 | A1 * | 5/2003 | Choi et al. | 8/158 |

FOREIGN PATENT DOCUMENTS

EP 1350881 A1 * 10/2003

* cited by examiner

*Primary Examiner* — Jason Ko
(74) *Attorney, Agent, or Firm* — Wenderoth, Lind & Ponack, L.L.P.

(57) ABSTRACT

Household-type front loading and water-recirculating clothes washing machine adapted to automatically measure the weight of the dry clothes loaded in the machine for washing, also on the basis of the information on the type of clothes in said washload entered from the outside (user), in which the measurement of such weight of the washload is performed by measuring the amount of water that is absorbed by the clothes in the washload when this is soaked with water to a point at which it is in a dynamic saturation, i.e. steady-state condition. Said measurement of the amount of water absorbed in the clothes is obtained by subtracting the amount of water that is present in the machine, and that does not interact with the washload, from the total amount of water let into the wash tub. The weight of the load of clothes is finally calculated by processing and interpolating the amount of absorbed water and rectifying such value with an information on the properties of the clothes in the washload.

4 Claims, 5 Drawing Sheets

PROPORTIONALITY BETWEEN THE WEIGHT OF AND THE AMOUNT OF WATER ABSORBED BY VARIOUS KINDS OF FABRICS IN THE WASHLOAD

HOUSEHOLD-TYPE WATER-RECIRCULATING CLOTHES WASHING MACHINE WITH AUTOMATIC CONTROL OF THE WASHLOAD WEIGHT, AND OPERATING METHOD THEREOF

FIELD OF THE INVENTION

The present invention refers to an improved clothes washing machine having a wash tub, inside of which there is a rotating clothes-holding drum having a substantially horizontal rotation shaft. Specifically, the washing machine is able to recirculate the wash liquor and is adapted to optimize the general performance capabilities thereof, i.e. a washing program enables the best possible results to be achieved under minimal usage data of the various process factors employed, water, washing products and electric power, along with the time needed to complete the washing program selected.

BACKGROUND OF THE ART

Clothes washing machines are generally known in the art to operate by letting into the washing tub a first amount of water together with the clothes to be washed and the required washing products, and then handling and processing the clothes until they are thoroughly clean. At the end of the washing program, the liquor used in the process is let off outside by means of a pump via an appropriate outlet pipe.

Equally well known in the art is the fact that all parameters of the washing process, i.e. the washing time, the number of rinses, the temperature, and the mechanical action, the chemical action of the washing products and aids are closely correlated with each other and markedly affected by what may be considered as being the determining factor the amount of clothes to be washed.

As a matter of fact, while it is fully apparent that the amount of clothes to be washed also determines the amount of water to be used, it has to be duly considered that the amount of water used in the process determines the amount of energy that is required to heat up that amount of water to a pre-established temperature. Further, the amount of washing product added can be validly brought into a mutual relation with the amount of water and a number of other factors. Finally, it should be noted that even the washing time (the duration of the washing process) is directly affected by the amount of water used and, accordingly, the washload (the amount of clothes) because it is generally known that the presence of just a modest washload inside a rotating drum of a clothes washing machine implies that such a washload is submitted to a mechanical action that is by far stronger than the one acting—with a less marked effect, of course—on a washload that fills up the entire drum.

It can therefore be stated that a reasonably exact knowledge of the amount of clothes loaded into the drum of the washing machine to be washed is practically a pre-condition to be known to set a washing program that causes the washing machine to operate in such a manner as to ensure optimum washing results under minimization of the machine operating requirements in terms of water, washing product and energy usage, as well as time needed to complete the washing process.

As a result, a sound determination of this factor becomes a basic step towards the ability for any other aspect of the washing process to be further improved.

A number of patent publications are known, which use different approaches to tackle the problem of determining the amount and type of the washload, mainly using a measurement of the amount of water totally absorbed by said washload.

Known from GB 2 076 648 (Miele & Cie.) is a front-loading clothes washing machine with a drum rotating about a horizontal axis and provided with such arrangements and operating provisions that, by measuring in a preliminary phase the amount of water that is on the whole absorbed by the washload, enable it to trace back—through proper processing and on the basis of previously measured experimental data—to an information correlating with the kind of washload in the drum.

Such method, however, has the following major drawbacks that put serious limitations to the practical effectiveness thereof:

1. A first drawback is that the measurement of the amount of water absorbed by the washload has, in all cases, to be carried out by causing the drum to become partially submerged in the underlying water bath contained in the washing tub; this condition is obviously required in order to let the clothes loaded in the drum interact with said water and cause the water itself to be absorbed by the washload held in the drum. However, this determines a water usage that is by far greater than the one actually needed, since use is made here of not only an amount of water such as needed to fully soak the washload, but also the amount of water that is needed to fill the bottom portion of the washing tub up to a level enabling the surface of the water in the tub to reach up to an adequate height above the bottom edge of the drum.

2. A second such drawback lies in the method being used; the amount of washload is not actually measured, but rather just processed out through a correlation with the amount of water absorbed by a plurality of washloads that differ from each other as far as both the amount of clothes involved and the kind and properties of the clothes in said washloads are concerned, as determined experimentally in a set of exhaustive test runs carried out beforehand. It can be readily appreciated that such correlation is a source of approximations, and related inaccuracies, not only as far as the methods used for the experiments, the calculations, and extrapolations carried out are concerned, but also due to the fact that, in any case, the calculated value does not take into account the great variability in the aptitude of the various types of fabrics in the washloads to absorb water. As a result, what is actually calculated is in all cases a conventional and not an actually measured value.

3. A third such drawback, owing to water having to be successively filled in the tub a number of times in order to restore the proper level such that each refill step is separated from the subsequent one by respective periods of rotation of the drum, is the proposed method turns out to be quite time consuming.

Known from the disclosure in GB 2 051 413 (Licentia) is a clothes washing machine that is substantially similar to the above described, and is practically adapted to control the amount of detergent to be dispensed into the wash tub based on the amount of water that is let into the same tub. Even in this case, it is not the amount of clothes introduced in the drum for washing that is measured. Rather, such information is worked out by a data processing method that is fully equivalent to the one described above, having the same drawbacks.

Known from the disclosure in EP 1 350 881 A1 is a method for measuring the washload in a front-loading clothes washing machine adapted to: determine the amount of water absorbed by the washload by subtracting, from the total amount of water let into the washing tub, the so-called free amount of water, i.e. the amount that is present in the tub, measured by a pressure switch or level probe; estimate the specific water absorption of the washload; calculate an equivalent (conventional) washload, i.e. load of clothes; and based on the result of this calculation, select and carry out a corresponding washing program.

Furthermore, all of the above processing steps are carried out on the basis of an estimation of the expected final values, which is obtained by detecting and evaluating the dynamic behavior obtained by calculating their derivatives versus time.

However, even this method has a number of practical limitations, such as the following: the equation relating the absorbed amount of water with the amount of water detected by the pressure switch or probe (free water) is admittedly (cf. the above-cited patent at page 2, lines 30 et seq.) involving a number of approximations owing to the interaction between absorbed water and free water; and further, a second approximation derives from an interpolation, using experimental data, based on the specific absorption, i.e. the ratio:

absorbed water/weight of washload

However, such parameter does not represent any constant data for each actual washload, but is rather a value that varies in accordance with the total amount of water filled in the washing tub (cf. above mentioned patent, page 3, lines 9 et seq., and in particular lines 14 and 15).

It may therefore be readily appreciated that, in the actual practice, the approximations introduced in this way, along with the generally acknowledged method-related limitations, altogether bring about an inaccuracy of such an extent as to impair a real effectiveness of the invention disclosed therein.

Briefly, the invention disclosed in the above-cited patent provides for somehow measuring a so-called "equivalent load" (cf. claim 1), but not the actual washload introduced in the machine.

In addition, even in this case the method suffers a drawback in that, owing to the need for the clothes to be soaked from the water bath in the washing tub, the tub has to be filled up to a level which is adequately higher than the lower limit or edge of the drum inside the tub, and this most obviously implies a fully appreciable water usage involving in turn a respective, but useless energy usage, which would preferably be avoided if water were filled into the tub only in such amount as strictly required to just soak the washload, and no more.

Finally, there is still a further drawback, and which is shared by all of the afore considered concepts. In fact, when the washing tub is filled, even partially, with water to such a level as to rise above the lower edge of the drum, the rotation of the same drum brings about an instability condition and a difference in the level being actually perceived, resulting in a instability in the pressure on the pressure or level control switch and an error in the signal delivered by the latter.

From US 2001/0052249A1 a washing machine is known which is able to avoid the undesirable condition found during a spray pretreatment portion of the wash cycle called "suds lock". When this condition occurs, contact of the fluid with the spinning basket acts to further increase the amount of suds which thus raises the height of the sudsy fluid toward the basket. The eventual result of this unstable process is that suds build up beyond the bottom of the basket and climb between the sides of the basket and tub. This large amount of suds acting between the spinning basket and the fixed tub produces a significant drag force on the basket. This drug force is large enough to cause the clutch to slip and, thus causing the basket to slow down considerably. This slipping of the clutch due to excessive suds between the spinning basket and the tub is called "suds lock".

Moreover, the machine is able to determine the size of the load, regardless of the type of fabric materials contained in the load. However, the disclosure only applies to, washing machines provided with a basket rotating only on vertical axis; and not on an horizontal axis, which is customary in Europe.

SUMMARY OF THE INVENTION

While the above disclosure solves avoiding "suds] lock" during a pretreatment step, or stain care cycle, and it would therefore be desirable to provide a washing method in a front-loading clothes washing machine provided with an arrangement to circulate the washing liquor, which is adapted to automatically measure the washload introduced in the drum on the basis of information to be entered by the user and concerning the type and, therefore, the properties of the clothes in the washload, as well as on the basis of an information on the amount of water absorbed by such washload under pre-established conditions, by processing such data and by performing interpolations with previously determined experimental data duly stored in the clothes washing machine itself.

In addition, the clothes washing machine of the present invention shall be easily manufactured using existing, readily available techniques; it shall further be competitively simple in its construction and convenient to use. In particular, it shall be capable of being implemented with only minor modifications to current washing machine designs. Moreover, the features added in accordance with the present invention shall by no means affect the reliability level of the washing machine itself.

BRIEF DESCRIPTION OF THE DRAWINGS

According to the present invention, these aims as set forth above are reached in a measurement method to be carried out in a kind of clothes washing machine that is provided with such operating and control means as described below by way of non-limiting example with reference to the accompanying drawings, in which.

DETAILED DESCRIPTION OF THE PREFERRED EMBODIMENT

Figure 1:
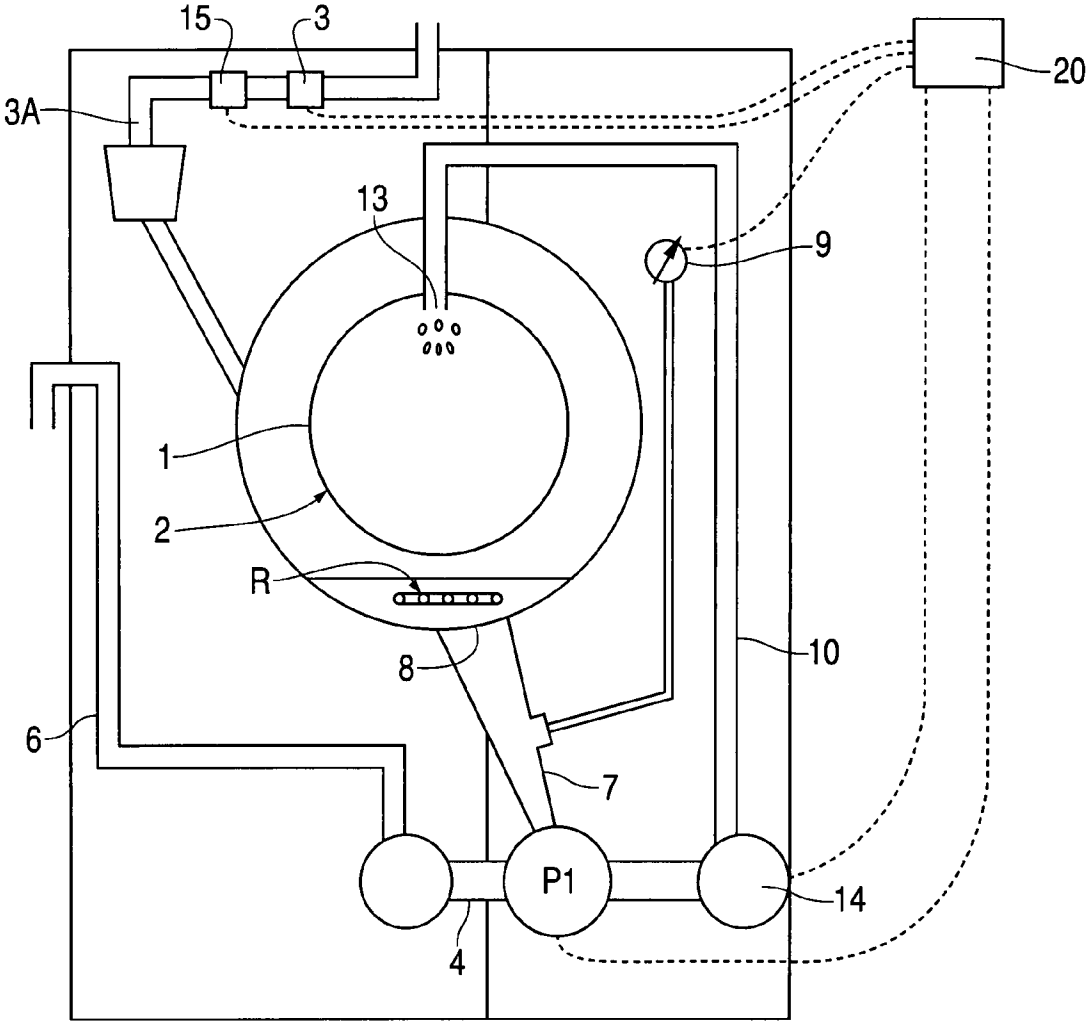
FIG. 1 is a symbolical view of the structure of and the functional devices and parts relevant to the present invention in a clothes washing machine of the household type.

The methodological approach, which the present invention is substantially based upon, is disclosed below.

In a clothes washing machine having a drum rotating about a substantially horizontal axis, the amount of water that is absorbed by a single washload at any particular instant is a function of a number of factors, among which the most important ones are:

the amount of clothes in the washload (weight of washload), the type of clothes, i.e. fabrics in the washload, in connection with the aptitude thereof to absorb water, additional factors include:

the rotating speed of the drum, the water level in the wash tub or extent to which the washload is submerged in the water, the temperature of the water being filled into the tub, other factors of a geometrical and mechanical nature relating to the particular construction of the machine.

Conversely, it can also be stated that each one of the above-mentioned factors can be singled out individually if it is isolated from the other ones or, in other words, if a sufficient number of experiments are conducted in which said other factors are appropriately varied, such as for instance by using such statistical techniques as the fractional factorial lab tests. The results of such tests and the related factors are correlated with the respective value assumed by the factor whose behaviour is to be identified, so that the value of the factor under examination, i.e. being considered, can be extrapolated from each single combination of such factors using well-known and largely accepted statistical techniques.

The above preamble has been set forth for the sole purpose of explaining, in a simple and straightforward manner, that if the weight of a load of clothes to be washed is to be desirably determined, all it takes to do this is to perform a sequence of appropriately designed experiments, in which the values of a test load, the values of the level of the water present in the wash tub, etc., are varied in a known manner and methodically associated to the resulting amounts of water absorbed by those varying loads, so that with easily done interpolations it is possible, by measuring a certain amount of absorbed water and knowing the values assumed by the other factors, to readily trace back to the value of the washload under examination.

Figure 3:
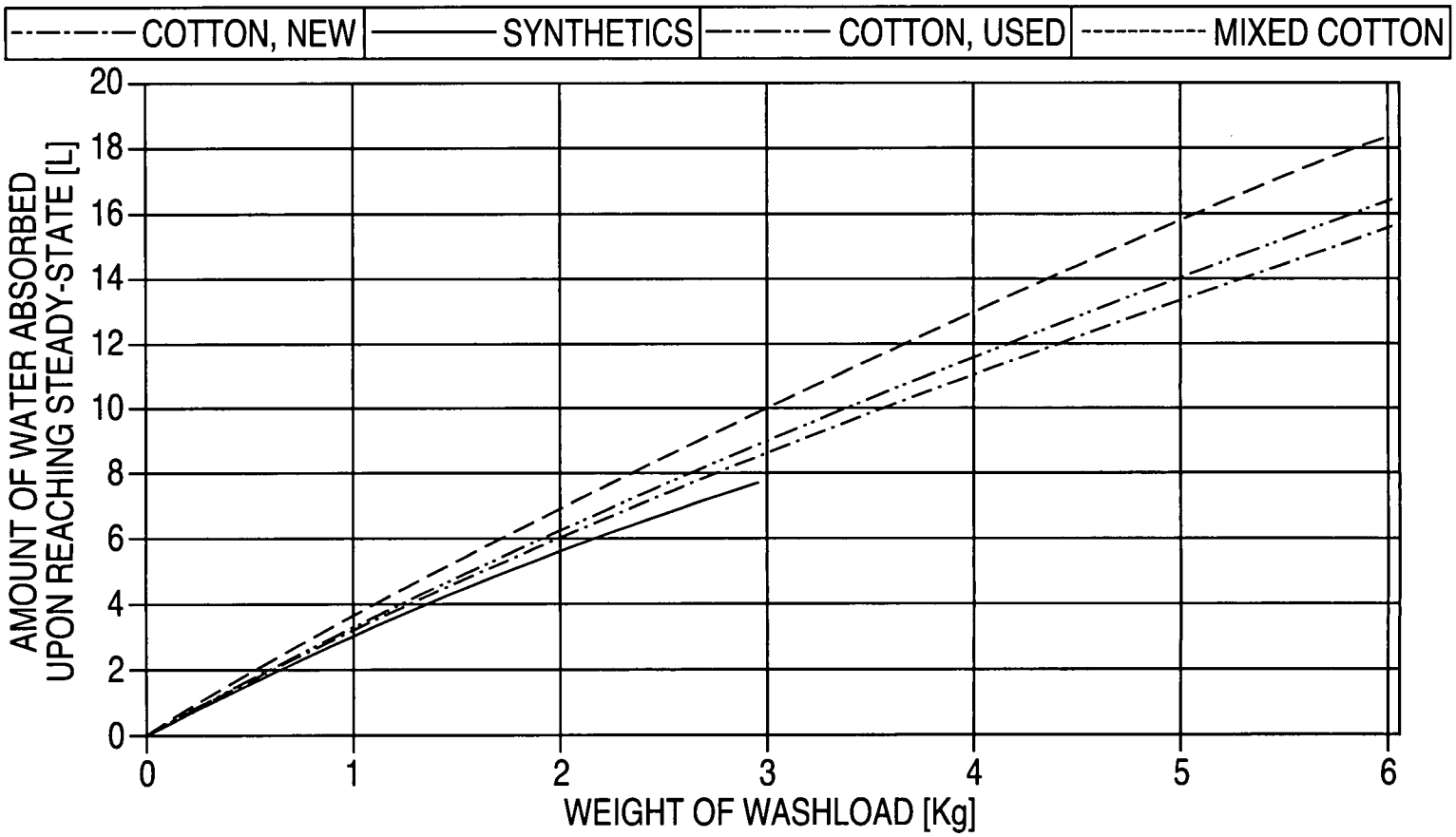
FIG. 3 is a diagrammatical view showing the relations existing between the weight of a given washload and the amount of water absorbed by such washload for different types of textile material used in the clothes forming said washload.

Each of the above-defined factors will be examined below:

a) amount of water absorbed by a load of clothes being tested (test washload): this is easily obtained by calculating the total amount of water let into the wash tub, e.g. by integrating the signal of an appropriate flowmeter fitted on the water inlet conduit, and subtracting from this value the amount of water contained in the bottom portion of the wash tub, i.e. not interacting with the washload. The value of this amount of water can be readily processed out by linking, by means of easily done experiments, the signal generated by an appropriate pressure switch or similar level control switch, which measures the height of the water level in the tub, with the corresponding "net" amount of such water, i.e. the amount left after deducting the volume occupied by the drum therefrom;

b) the type of clothes or fabrics in the washload: this information is not measured by the machine, but is rather entered as an input by the user of the washing machine herself prior to starting a washing program, wherein such input is then duly introduced in the procedure for the calculation of the particular washload. It is to be particularly stressed that this fact is distinctive of the present invention with respect to the afore cited state of the art. The fact that the type of fibers, which the fabrics in the washload are made of, significantly affect the actual amount of water that is absorbed by the clothes, all other conditions being equal, is widely known art. FIG. 3 diagrammatically illustrates how the amount of water absorbed by a given washload depends, further of course on the weight of the load, also on the type of fibers which the respective fabrics and clothes in the load are made of;

c) other factors, such as the speed of rotation of the drum, the temperature of the water, as well as the geometrical and mechanical characteristics of the washing machine. All these factors are kept at a definite, constant value both during the preliminary experiments carried out to measure the correlation of the various factors with each other, and during the measurement of the amount of water that is absorbed by the washload under examination. In this way, the effect of said factors is duly and automatically incorporated in both the determination of the relations existing between said factors and the measurement of the amount of absorbed water. Because these factors are not subject to any modification, their effect on the comparison of the measured data with each other is obviously nil, in the sense that if the amount of absorbed water is found to change, this can only mean that such change is solely ascribable to a change intervened in the washload under examination since, owing to said other factors being constant, the effect thereof on said change can only be nil;

d) the level of water present in the wash tub it should be noted, and most clearly stated, that the present invention applies to clothes washing machines that enable the clothes in the washload to be soaked by a jet generated by an appropriate water circulation circuit and a pump associated thereto, which hits the clothes from, for example, a site situated close to the front loading door of the machine, without any need for the water provided for such washing process to actually flow into the drum, and reach the clothes contained therein, by rising from the bottom portion of the tub.

Such circumstance has a twofold advantage: first, the water usage is drastically reduced, owing to reasons that are well-known to and, in any case, most readily understood by all those skilled in the art, so that they shall not be explained here any further. Second, because the tub is not filled with water, but simply collects from the bottom the water that falls thereonto from the drum that is sprayed by said jet throwing water thereinto, this water is conveyed into the sleeve 7, this shall be explained in greater detail further on. In practice, the tub operates with just a very small amount of water in it, wherein the level of this water lies in any case below the lower edge of the drum. Sometimes, and solely for reasons of safety, such level of the water may be allowed to lie above the level at which the heating elements are situated.

In practice, this means that the variable relating to the water level in the drum is eliminated, and reduces the number of the factors that need to be considered; resulting in an improved correlation between the amount of absorbed water and the amount of clothes loaded in the drum.

At this point, it should be strongly noted that in order to carry out all these measurements and comparisons, it is necessary for standard and constant conditions to be defined, under which said measurements are to be made.

Because the amount of water absorbed by the clothes in a washload depends also on the length of time during which the water is allowed to be in contact with said clothes, the measurements are assumed to be carried out in a precisely defined condition, i.e. when the water absorption reaches a dynamic balance or steady-state condition, meaing that the amount of water being absorbed is equal to the amount of water being released by the fibers under examination in the same time length.

This occurrence can be verified by means of a simple procedure; an initial amount of water is poured onto the washload, followed by subsequent amounts intended to restore said initial water filling, while repeatedly measuring the amount of water being released from the washload, and falling onto the bottom of the tub, so as to check it for stabilizing at a substantially constant value. Because it is this water that the flow of circulated water being returned to the clothes in the drum is taken in a continuous manner, it can be readily appreciated that said condition of dynamical balance occurs when the amount of water being returned into the drum is found to be equal to the amount of water that falls therefrom, i.e. when the level on the bottom portion of the tub becomes substantially constant.

With reference to FIG. 1, the method according to the present invention applies to a clothes washing machine that comprises a perforated drum 1 rotatably arranged inside a sealed tub 2; a device for letting water from the water supply line into said tub comprises an electromagnetic valve 3 and a conduit 3A connecting said electromagnetic valve with said tub.

Below the tub there is provided a drain manifold 4 connected with the outlet pipe 6 on one side and the sleeve 7 on the opposite intake side, the other end of said sleeve 7 being in turn connected with an opening 8 provided in the bottom of said tub.

In an appropriate position along said sleeve 7 there is further provided a tap for a pressure switch 9 to be connected to.

Because the present invention applies to a clothes washing machine provided with a feature for re-circulating the washing liquor into the drum, there is suitably provided a so-called re-circulation manifold 10 connected via a conduit 11 to known means 13, such as an appropriate nozzle, adapted to direct a jet of water into said drum. Although such nozzle 13 is illustrated as being seemingly arranged inside the drum, other solutions are however possible, in which said means 13 is for example situated on the upper side of the loading door gasket and the water jet issuing therefrom enters the drum and hits the clothes directly, without passing first through the perforations in the walls of the same drum.

Also, said re-circulation manifold 10 is provided with an appropriate pump 14 adapted to take in the liquor from the drain manifold and pump it towards said means 13, from which the liquor is then sprayed into the drum.

On the conduit that carries the water from the water supply line, or on said conduit 13A, there is fitted a device 15, which measures the flow rate and, therefore, the amount of water that is let into the machine on the whole; such device can for instance be a flowmeter of any standard type, or the like, which is associated to processing means adapted to integrate the signal generated by it with the time.

Furthermore, said clothes washing machine is provided with control means 20, connected to said flowmeter and the other operating or functional parts of the machine, wherein said control means are also adapted to receive the start command entered by the user. In addition, said control means are adapted to also receive a command that is representative of the various types and kinds of fabrics that may be included in a washload.

According to the present invention, said clothes washing machine automatically carries out a determination of the weight of the washload introduced in the drum by following the procedure that is explained below, i.e. the procedure that is illustrated schematically in the block diagram of FIGS. 2A and 2B, where at certain blocks there is indicated a number that corresponds to the action of that step or the action of a following step having the same number as the one appearing in that block.

At 201, prior to starting a washing cycle, the washing machine takes in a given amount of water for the same to reach up to a pre-set, generally low level inside the wash tub, as measured by the pressure switch or similar level probe 9; as soon as this level is reached, the electromagnetic valve 3 is closed automatically.

As an alternative option, instead of the signal delivered by said pressure switch or level probe 9, the signal delivered by the flowmeter 15 indicating the instant flow rate of the water filled into the machine can be used, e.g. suitably integrated with time.

At the same time as this action is being carried out, the time starts to be measured by means of a timer included in said control means.

At 202, the water re-circulating pump 14 is started and allowed to operate throughout the duration of the next step of the procedure.

At 203, drum starts to operate in a continuous manner by performing alternate rotating cycles at low speed in both directions of rotation, so that the clothes are allowed to keep tumbling on the bottom of the drum, where it is reached by the jet of water issuing from the nozzle 13.

The clothes in the washload start to absorb the water, which they are being sprayed with, and to release part of such water through the drum and onto the bottom of the wash tub, from which said water is taken in and conveyed again into the drum by the re-circulation manifold 10.

The level control pressure switch detects the height of the water level on the bottom of the wash tub and sends the related information—preferably in a continuous manner—to said control means 20.

At 206, the time elapsed from the beginning of the procedure keeps being measured; this function is of a basic importance, since it determines, jointly with other factors that shall be better explained further on in this description, the type and the sequence of the events to come.

Figure 2A:
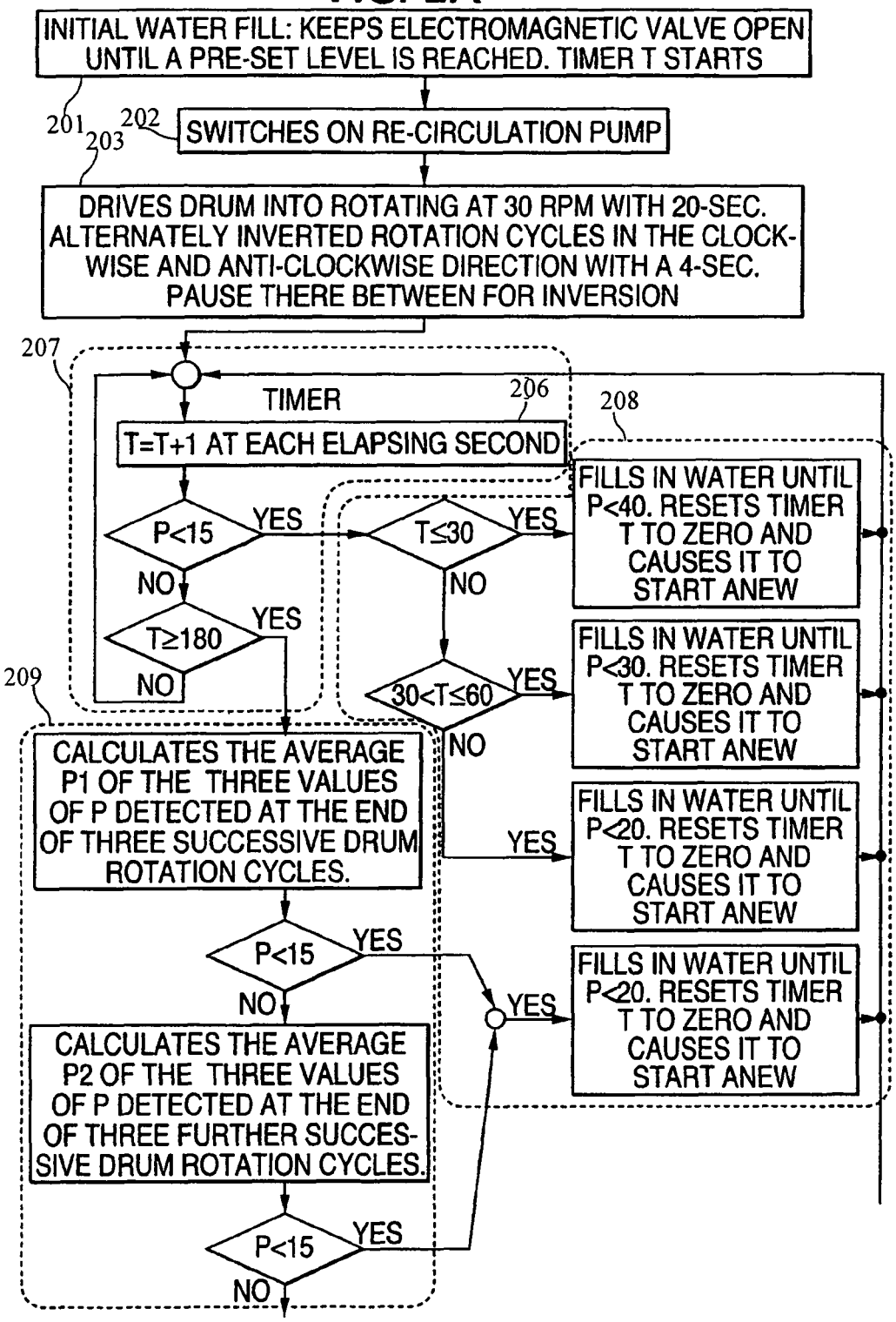
FIG. 2 is a diagrammatical view showing two curves that are representative of two functional variables in a clothes washing machine operating in accordance with the present invention.

At 207, a sub-routine is started, the actions of which are indicated in the logic blocks of FIG. 2A, and which check the level for being lower than a pre-set level ($p<15$ in the example illustrated); if this condition is, true (YES), this means that there is just a very small amount of water in the wash tub and, therefore, the clothes in the washload are still absorbing water, so that it is necessary for an additional amount of water to be filled in, in accordance with the next sub-routine 8 that will be explained further on; if said condition is on the contrary detected as not being true (i.e. NO), this may mean that the dynamic steady-state or water absorption balance condition has been already reached by the clothes. However, prior to starting a new verification, the time elapsed from the last closure of the electromagnetic valve is duly checked for being longer than a pre-set time value ($t\geq180$), since it would otherwise be assumed that there has been no adequately long a time available to allow the clothes in the washload to take up, i.e. absorb as much water as actually possible.

At 208, a sub-routine is performed, which controls said electromagnetic valve into opening and closing based solely on the time elapsed from the last closure of said electromagnetic valve.

Figure 2B:
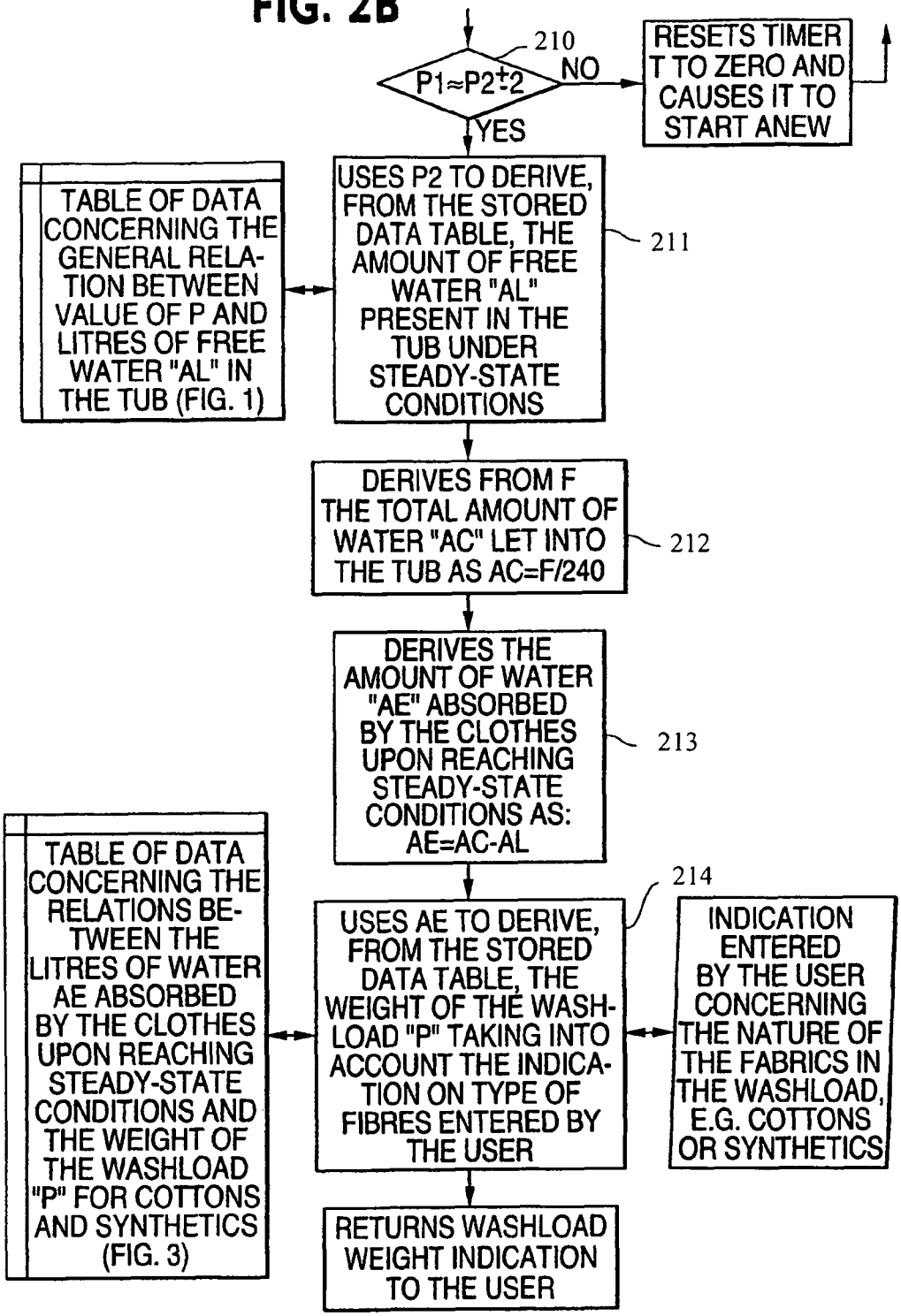

In FIGS. 2A and 2B, the logic and functional blocks that are circled by a dashed line indicated at 208 as a reference numeral, are included in this sub-routine. In this connection, it should also be noticed that the letter "p" in the Figure is used to indicate the signal of the level control pressure switch, or probe, and, therefore, refers to the water level in the wash tub, whereas the number associated to that letter indicates. In a conventional manner, a pre-defined reference value of the same level. Similarly, the letter "t" is used to identify the time elapsed from the last reset-to-zero of the timer, while the numeral associated therewith expresses—in seconds—the value of a pre-defined reference time length.

The above sub-routine causes said electromagnetic valve to go through a sequence of opening and closing cycles, in which each opening of the valve is triggered upon the water being detected to have reached a pre-determined level, which will have been previously defined solely on the basis of the time elapsed from the end of the previous water refilling step to the beginning of the current water refilling step.

If this time is found to be short, this will mean that the water has been absorbed by the clothes at a quite high rate, i.e. very quickly, while being released by the same clothes in a just small amount, so that it can be assumed that the clothes in the washload were dry or just slightly wet and, therefore, it is necessary for an additional, rather significant amount of water to be filled in so as to cause a consistently higher level to be reached in the tub. If such time is otherwise detected to be long, this on the contrary will mean that just a small amount of additional water is actually needed to reach a steady-state, i.e. balance condition in the water absorption by the clothes, which is actually the targeted condition, so that just a quite smaller amount of water is further added, which causes an obviously lower level to be reached in the tub.

Of course, such sequence of: opening of the electromagnetic valve, calculation of the time elapsed from the end of the last water refilling, consequent automatic determination of the new level to be reached, detection of the new level being reached in the tub, and consequent automatic closing of the electromagnetic valve, is part of a pre-programmed routine included in said control means 20, in which both the correlation of the measured time data with each other and the determination of the new level to be reached, and possibly even the highest allowable number of successive water refillings, can be freely selected in accordance with the desired results, as duly and adequately verified experimentally.

At 209, a condition is further determined, which conventionally defines the state in which a dynamic balance or steady-state condition is reached in the water absorption by the clothes; when this condition is detected as being reached, the procedure for filling additional amounts of water in the tub is stopped.

This condition occurs when the amount of water sprayed onto and absorbed by the clothes in the drum equals the amount of water that is released by the same clothes and collects on the bottom of the tub to be further conveyed into said sleeve 7. Under these conditions, wherein the water re-circulating circuit is operating continuously, said dynamic water absorption balance state is detected as being reached when the level of the water on the bottom of the tub, or in the sleeve 7, becomes substantially constant.

This condition may be measured in various manners with respective degrees of accuracy.

A preferred manner is based on determining two successive, although not necessarily adjoining time intervals and measuring the level of the water within said intervals either continuously or at predefined times.

The average of the levels measured in the respective ones of said two time intervals is then calculated and the two resulting average values are compared with each other; these actions are synthetically illustrated in the blocks that are jointly circled by the dashed line indicated at 209 in FIG. 2A, much in the same way as done in connection with the formerly described sub-routine.

At 210, if the difference between said two average values is found to be smaller than a certain pre-defined value, the dynamic balance condition of the water level is assumed as having been reached.

It is appreciated that a number of other methods are available for measuring said condition of dynamic balance. These shall however not be explained here any further, because it is within the normal ability of those skilled in the art to identify them in accordance with the particular constraints, primarily as far as the measurement time and the desired accuracy are concerned.

A second method that can be used to ascertain the existence of a dynamic balance state consists in continuously checking the duration of the last water refilling step for it to be shorter than a pre-set value.

A third method may for example further consist of a suitable OR-type or AND-type combination of the two dynamic balance conditions found and measured according to the above-described methods.

It will be readily appreciated that such condition is a purely conventional condition, and a convenience-dictated one, and the processing and control program that is passed on to said control means 20 of the machine is appropriately set as a result, i.e. based on such convention.

At 211, after the electromagnetic has been caused to definitely close, the level control switch or probe is used to determine, with the aid of means known in the art, the residual amount of water in the tub. Additionally, the water lying under the tub, and not measured by the level control switch, must of course be duly taken into account, because it is part of the total amount of water let into the machine; it should be noted that on the bottom of the tub there is ideally present just a minimum amount of the water.

At 212, the total amount of water let into the machine is calculated from the measurement data generated by the flowmeter 15.

At 213, the amount of water measured as per 211 above is subtracted from the amount of water measured as per 212 above, thereby obtaining the "net" amount of water absorbed by the clothes in the washload under steady-state or balance water-absorption conditions.

At 214, the obtained result is rectified on the basis of the information entered by the user concerning the type of fabrics in the washload (specific water absorption properties) to obtain, through easily done, automatic interpolations and means that are well known as such in the art, the final value of the weight of the "dry" washload.

From this moment on, the program goes on with its sequence of operations in an easily imaginable manner that has no relevance as far as the present invention is concerned.

Figure 4:
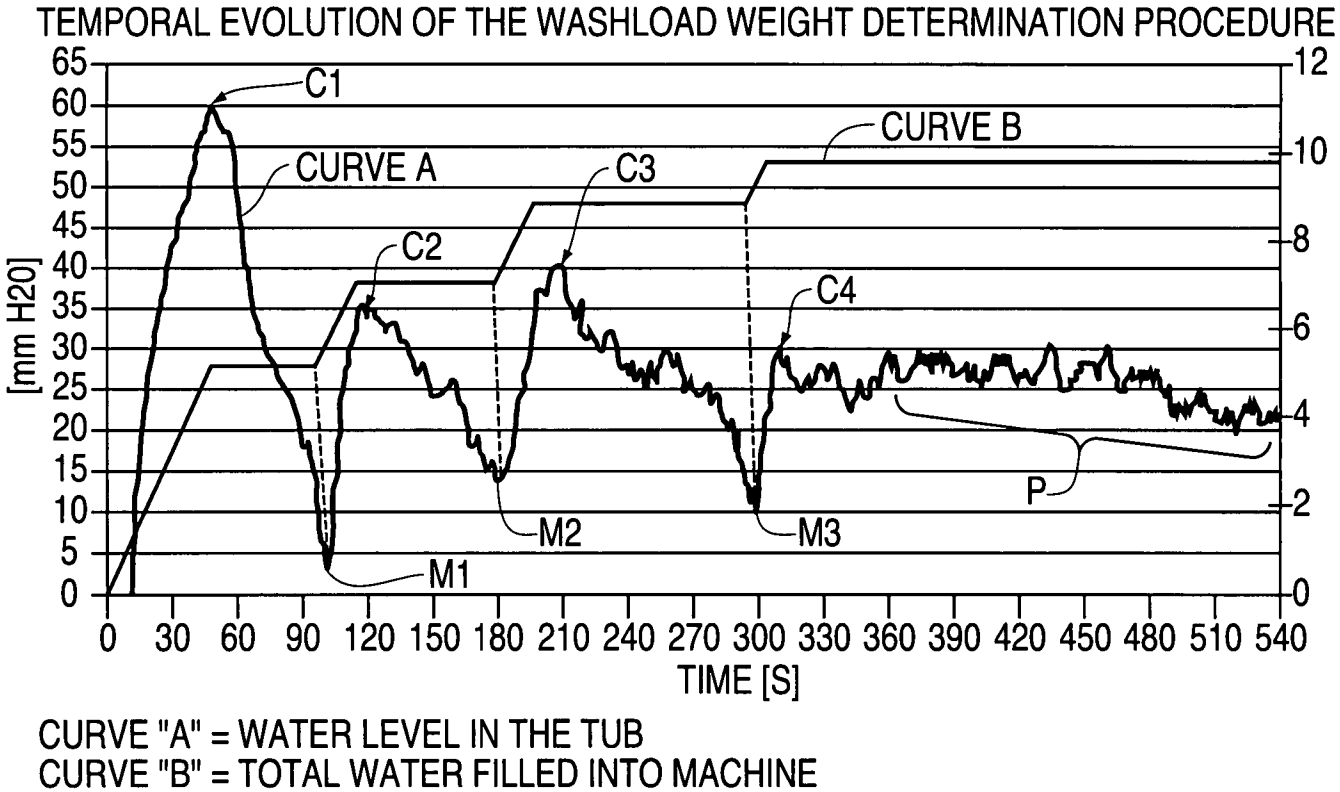
FIG. 4 is a block diagram showing symbolically the main steps involved in the method according to the present invention.

It can at this point be more readily appreciated that the above-described method can be implemented in a clothes washing machine of a generally known kind, and operating based on the wash-liquor re-circulation principle, without any modification or adaptation being required as far as the hardware is concerned, as long as the control unit 20 of the machine is duly provided and set with an appropriate operation program including also the information and data that have been previously found experimentally in that same type of washing machine. In this connection, reference should be made to the diagram illustrated in FIG. 4: curve A in this diagram represents the amount of water detected as being present on the bottom of the tub, while curve B represents the total amount of water let into the machine (integration of the flowmeter signal), as a function of time (as represented on the axis of abscissas). These curves have been measured in a strictly production-run washing machine, i.e. a machine taken directly from the production line, in which the sole operation program stored in the control unit 20 had been updated in accordance with the above described method.

It should be specially noticed that the points C1, C2 and C3 on the curve A represent the instants at which the electromagnetic valve is closed and, therefore, starting from each one of these points the level starts to decrease, whereas at the instants indicated at M1, M2 and M3 said level starts to increase again; it will also be readily appreciated that the electromagnetic valve is caused to open a certain short time in advance of such instants, because it should also be considered that there will unavoidably be a small delay from the moment at which the electromagnetic valve is triggered to open to the moment at which there is an actual increase in the level of the water in the tub, due to the need for the water inlet circuit 3A to be first filled and the water to be allowed to reach the bottom of the tub.

In correspondence to the point C4 there occurs the last water refilling, after which, once that the level has been ascertained in a conventional manner to have stabilized during the period P, using one of the methods described under 209 and 210 above to that purpose, the operations described under 211, 212, 213, and 214 above are carried out in view of obtaining the desired value of the weight of the washload.

The above description has been set forth in an intentionally synthetic, i.e. concise manner so as to be more readily understood in the basic logic thereof; electronic-type and similar technicalities, along with a too detailed explanation of the contents and the functions of the blocks in FIG. 2 have been omitted as well, owing to them having been considered as being not only fully superfluous for those skilled in the art, but even plainly detrimental since they would have certainly made the logic handling of this matter dull reading, without on the other hand adding any element that might prove really necessary for a better understanding thereof.

The invention claimed is:

1. A method of operating a clothes washing machine having a wash tub, said method comprising:

prior to starting a washing cycle, letting an amount of water into the clothes washing machine up to a first pre-set level in the wash tub or up to a known volume in the wash tub;

taking from the bottom of the wash tub the water previously let into the machine and re-circulating the water such that the water is sprayed into a washload-holding drum arranged inside the clothes washing machine, such that the water is sprayed onto clothes to be washed contained within the washload-holding drum;

rotating the washload-holding drum at a low speed with alternate rotation cycles in two directions of rotation along a horizontal axis of rotation;

detecting a height of the water from the bottom of the wash tub, the height of the water from the bottom of the wash tub being lower than a second pre-set level; and carrying out a sequence of water refillings and water supply interruptions in the clothes washing machine, and measuring an elapsed time between the end of a previous water refilling and the beginning of a current water refilling, when the height of the water from the bottom of the wash tub is detected as being lower than the second pre-set level, wherein each of the water refillings, with the exception of the first water refilling, is done until the height of the water from the bottom of the wash tub reaches a previously defined level, the previously defined level being previously defined solely dependent on the measured elapsed time between the end of the previous water refilling and the beginning of the current water refilling.

2. The method according to claim 1, further comprising:

comparing an elapsed time from the end of the letting the amount of water into the machine up to the first preset level to a predetermined time, and verifying whether a steady-state water absorption pattern of the clothes in the washload-holding drum has been reached based on the comparison, when the height of the water from the bottom of the wash tub is detected as being higher than the second pre-set level;

calculating an amount of water present in the wash tub and water-carrying circuits of the clothes washing machines based on the detected height of the water from the bottom of the wash tub, when the steady-state water absorption pattern of the clothes in the washload-holding drum is verified as having been reached;

calculating a net amount of water absorbed by the clothes in the washload-holding drum by subtracting the calculated amount of water present in the wash tub and the water-carrying circuits of the clothes washing machine from a total amount of water having been let into the clothes washing machine; and obtaining a dry weight of the clothes in the washload-holding drum by comparing the net amount of water absorbed by the clothes in the washload-holding drum with fabric information about the clothes in the washload-holding drum entered by a user.

3. The method according to claim 2, wherein the steady-state water absorption pattern of the clothes in the washload-holding drum is verified when (i) the difference between a first average value of the height of the water from the bottom of the wash tub detected throughout a first time interval and a second average value of the height of the water from the bottom of the wash tub detected throughout a second successive time interval is lower than a third pre-set value, or (ii) a duration of an immediately prior water refilling is shorter than a pre-defined time.

4. A method of operating a clothes washing machine having a wash tub, said method comprising:

prior to starting a washing cycle, letting an amount of water into the clothes washing machine up to a first pre-set level in the wash tub or up to a known volume in the wash tub;

taking from the bottom of the wash tub the water previously let into the machine and re-circulating the water such that the water is sprayed into a washload-holding drum arranged inside the clothes washing machine, such that the water is sprayed onto clothes to be washed contained within the washload-holding drum;

rotating the washload-holding drum at a low speed with alternate rotation cycles in two directions of rotation along a horizontal axis of rotation;

detecting a height of the water from the bottom of the wash tub, the height of the water from the bottom of the wash tub being lower than a second pre-set level;

carrying out a sequence of water refillings and water supply interruptions in the clothes washing machine; and measuring an elapsed time between the end of a previous water refilling and the beginning of a current water refilling, wherein each of the water refillings, with the exception of the first water refilling, is done until the height of the water from the bottom of the wash tub reaches a previously defined level, the previously defined level being previously defined solely dependent on the measured elapsed time between the end of the previous water refilling and the beginning of the current water refilling.

* * * * *